US005881516A

United States Patent [19]

Luedtke

[11] Patent Number: 5,881,516

[45] Date of Patent: Mar. 16, 1999

[54] BEARING WALL CONSTRUCTION SYSTEM WHEREIN AXIAL LOADS OF WALLS DO NO PASS THROUGH THE FLOOR CONSTRUCTION

[75] Inventor: Charles William Luedtke, deceased, late of Atlanta, Ga., by Mary Catherine Luedtke, executor

[73] Assignee: ELR Building Technologies, LLC, McMinnville, Tenn.

[21] Appl. No.: 670,619

[22] Filed: Jun. 26, 1996

[51] Int. Cl.[6] ..... E04B 1/38

[52] U.S. Cl. ..... 52/236.3; 52/272; 52/283

[58] Field of Search ..... 52/272, 283, 657, 52/695, 223.6, 236.3

[56] References Cited

U.S. PATENT DOCUMENTS

| | | |
|---|---|---|
| 505,031 | 4/1893 | Heydon . |
| 915,074 | 3/1909 | Craig . |
| 1,124,404 | 1/1915 | Featherstone . |
| 2,104,500 | 1/1938 | Van Buren . |
| 2,302,101 | 11/1942 | Boydstun . |
| 3,110,982 | 11/1963 | Besinger . |
| 3,722,159 | 3/1973 | Kessler . |
| 3,897,663 | 8/1975 | Gaul . |
| 4,302,915 | 12/1981 | Stocks . |
| 4,486,993 | 12/1984 | Graham et al. . |

*Primary Examiner*—Robert Canfield

*Attorney, Agent, or Firm*—James W. Kayden, Esq.; Thomas, Kayden, Horstemeyer & Risley, LLP

[57] ABSTRACT

Disclosed is a new method of constructing structures of all types and heights. The invention utilizes a metal "Z" shaped member or plate along with other metal shapes that permit a floor system to bear outside of the plane of the bearing wall. The invention further relates to methods of controlling disadvantageous shrinkage in wood frame building. The invention further teach a more economical and efficient method and structure for tensioning diagonal tension straps after framed walls are erected.

6 Claims, 9 Drawing Sheets

BEARING WALL CONSTRUCTION SYSTEM WHEREIN AXIAL LOADS OF WALLS DO NO PASS THROUGH THE FLOOR CONSTRUCTION

BACKGROUND OF THE INVENTION

Construction of reduced mass and simplified structures that efficiently perform all of the functions that traditional concrete, masonry, or structural steel buildings perform has long been a goal in building sciences. Mass reduction saves foundation costs, reduces the horizontal loads due to seismic events, and generally decreases the amount of materials required per unit of construction.

Use of spaced load bearing elements for walls can greatly reduce the mass of the structure and has been developed for wood framing to five stories and light steel stud framing to eight stories. Platform framing details for wood frame buildings over two stories can create excessive shrinkage over the height of the building and cause, among other things, high long term repair costs and undesirable cracking. Light steel framed buildings have heretofore been limited by the load capacity of joist end details over the bearing walls and by the complexity and cost of such details.

U.S. Pat. Nos. 4,918,897 and 5,048,257 describe methods of attaining a continuous diaphragm slab and tensioned diagonal strap horizontal load resisting elements. These patents do not resolve the problems of end bearing complexity that limit building heights nor do they address the use of continuous diaphragms and tensioned straps in wood frame structures.

In pre-cast concrete wall bearing structures, the floor structure must be placed over the pre-cast concrete wall and have a bearing surface thereon that is perfectly smooth, has a steel plate or grouped tie bar connection, and must be placed before the next level of walls is erected. The resultant structure is very heavy and often has connections that are difficult to conceal or has very labor intensive grouped connections.

SPECIFICATION OF THE INVENTION

This invention relates to a new method of constructing structures of all types and heights. It utilizes a metal "Z" or plate along with other metal shapes that permit a floor system to bear outside of the plane of the bearing wall. Means are provided to allow the structural frame to be erected to six or eight stories with un-topped floors. This allows full building enclosure with safe working areas as the building is erected. The installation of pipes, conduits, and ducts may be placed between the floor levels and be fire and acoustically sealed by the cementicious topping placed after erection of the building under controlled conditions. It also relates to methods of controlling disadvantageous shrinkage in wood frame buildings heretofore unknown in the art and allows the use of concrete and steel framed floors that provide acoustic advantages and may be economically and quickly constructed.

This invention also teaches a more economical and efficient method for tensioning diagonal tension straps after framed walls are erected.

It is, therefore, one of the primary objects of this invention to provide an improved method of constructing multi-story buildings utilizing metal "Z" members or metal plate bearing surfaces that allow bearing walls to be continuous from foundation to roof without bearing upon the floor construction.

Another object of the present invention is to substantially decrease sound flanking paths over the top of a wall at the floor line and permit fire and acoustic sealing of pipes, ducts, and conduits that penetrate the floor without using additional special materials.

A further object is to provide a safe working environment immediately upon erection of bearing walls, enclosure walls, and metal decking before concrete is placed.

A still further objective is to allow wood frame buildings to avoid combustible floor construction and achieve a continuous diaphragm of metal decking and cementicious materials.

Another object is to permit light steel construction for buildings of any height.

An additional purpose is to provide a means of pre-tensioning diagonal tension straps by one person in a very simple and economical way.

A structure of panelized light gauge metal, wood frame, or pre-cast concrete walls is erected upon a foundation. Sheathing material may be pre-applied to the light metal or wood framed walls and metal decking installed upon metal plates or "Z" members attached to the tops of the wall panels. Windows, doors, and other opening protective devices may be pre-installed along with insulations and weather proofing to provide an enclosed working environment that allows follow-on trades to work under environmentally controlled and safe conditions. Up to six further levels may then be erected while mechanical trades are working in the level below placing cementicious topping on the metal decking.

DETAILED DESCRIPTION OF THE PREFERRED EMBODIMENT

Figure 1:
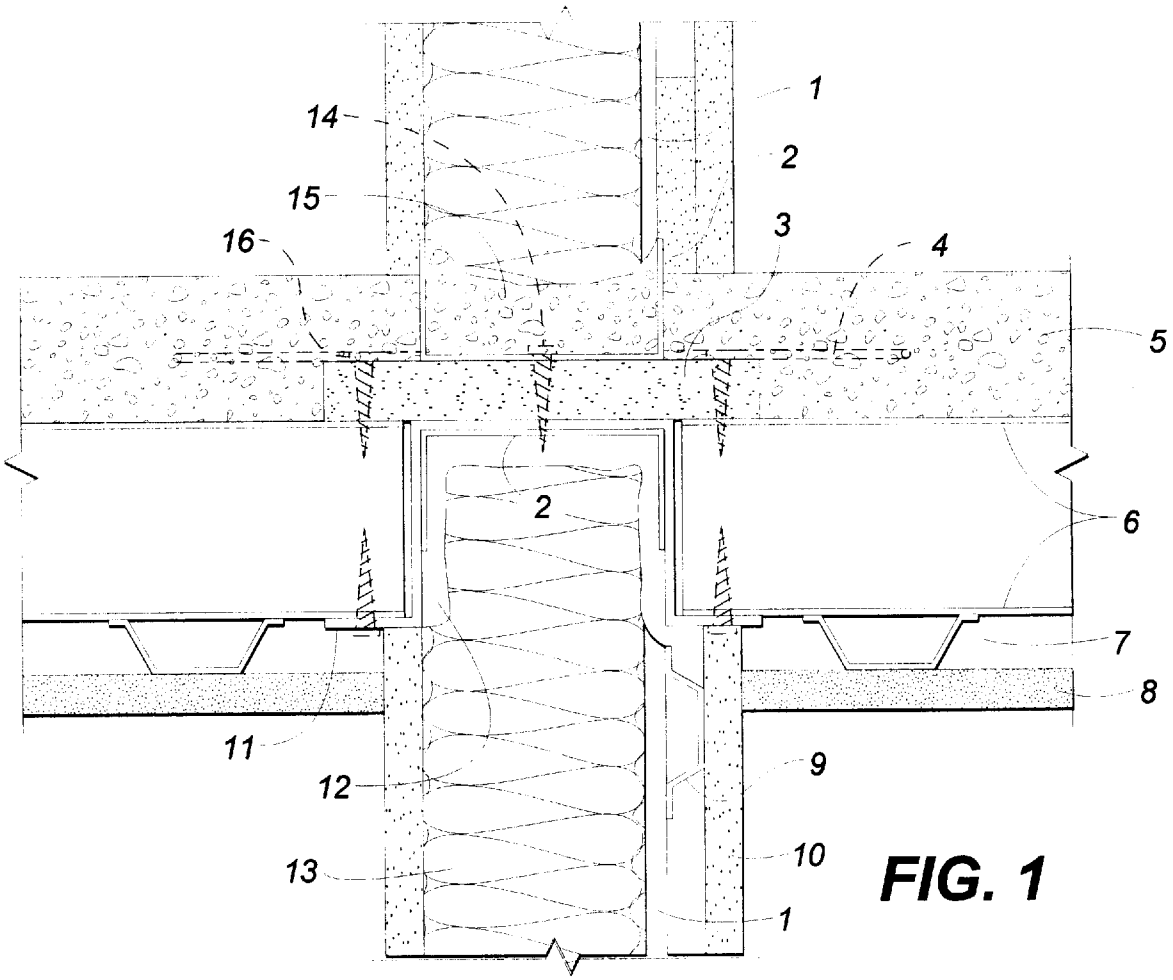
FIG. 1 is a sectional view of a floor wall intersection showing components of a deck floor and steel stud bearing wall.

Referring now more specifically to the drawing and to FIG. 1 in particular, one embodiment of the present invention is shown. When a stud track utilizing a metal bearing "Z" or plate is attached to an adjacent, (i.e. upper or lower) floor, there is little acoustic separation between floors. With continuous pour slabs, there is damping between the floors. When a metal decking system is used, the lack of deck rigidity at the bearing points can be dangerous and can cause permanent damage to the deck prior to the concrete pour. The present invention provides what becomes effectively a continuous slab, but which has metal to metal separation plus rigidizing of the deck.

FIG. 1 illustrates the invention wherein number 1 designates the bearing studs of a metal stud wall. Secured along the bottom of the metal studs are bottom and top tracks 2, within which the bearings studs are seated. Numeral 3 refers to a fiber cement piece which may have ladder wire reinforcement 4 over the fiber cement piece. Disposed within the bottom tracks 2 is fiber reinforced concrete 5. The fiber reinforced concrete is applied over the composite metal deck 6 which serves as a deck for the upper level and as a ceiling component of the level located directly therebelow. Furring members 7 are optionally provided for the undersurface of the composite metal deck 6 for application of a drywall ceiling finish 8. To provide for acoustic sealing of pipes, conduits and the like, an acoustic channel 9 is provided on a side of the bearing studs 1 to support gypsum board 10, which serves as a fire protection means. Disposed across the top of the bearing stud at the ceiling level is a wall cap 11 having laterally extending legs which help to support the metal deck 6. Acoustic sealant is sprayed on, around and under the wall cap and batts of fiberglass or other suitable material 13 may be placed between the bearing studs on one side and the gypsum board 10 on the opposite side. A screw 14 or other suitable fastener is disposed through the fiber cement piece 3 to secure together the bottom track 2, the fiber cement piece 3 and the wall cap 11. Fiber reinforced concrete is disposed over the fastener in the bottom track 2 to complete the seal and provide a rigid structure. The fiber cement piece is also secured to the composite metal deck using screws 16 or other suitable fasteners.

This invention allows stud walls prefabricated in appropriate pieces to be erected by floor and then have a wall cap installed to allow a floor deck to be immediately placed. The deck is screwed from below through the contact flutes and then the wall cap fiber cement piece is screwed into the top of the deck. At this point the deck is usable as a walking surface. The prefabricated stud wall for the next floor may then be screwed down. Diagonal tension straps may be tightened on each floor as soon as the panels i.e. the stud walls are placed, as discussed in further detail hereinbelow. Concrete may be poured after three floors are erected and pipes, conduit, and other through floor services are installed to allow a seal for fire protection of the through floor services and pipes. The height of the building so erected is limited by fire ratings required on the bearing walls and the floors. This system provides a floor with fire ratings without a ceiling finish, superior stopping of acoustic bridging across the tops of the walls and elimination of metal to metal contact. It provides a diaphragm across walls that can transfer much of the horizontal loads for mid-rise buildings.

Figure 2:
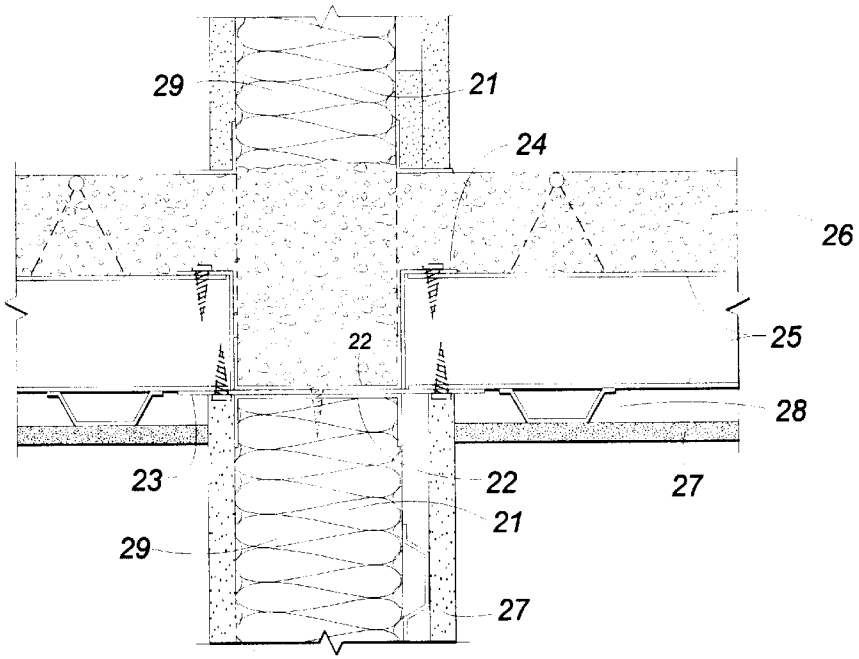
FIG. 2 is a sectional view of a floor wall intersection showing a plate type bearing and tee angles for decking and a steel stud bearing wall.

FIG. 2 illustrates an alternate design which requires no wall cap, sprayed acoustic sealant or fiber cement board separation piece. This embodiment is similar to the first embodiment in that 21 designates the metal studs which make up the bearing wall, having top and bottom standard tracks 22 placed thereover or thereunder respectively. A metal plate 23 of 12 to 16 gauge material is disposed at the top of a stud wall and extends approximately 1 and ¼ inch beyond the stud width on each side. The metal plate is thus 6½ inches for a 4 inch stud wall. The metal plate is screwed in place with a self-tapping screw or like fastener at each flute. A metal L member 24 is used to reinforce the top of the flutes in the decking and to close off the ends of the deck to prevent concrete run through. This may be the same gauge as the deck and may be applied with the deck in place or it may be pre-applied. Mastic and/or screws may be used to fasten the metal L member. This structure then includes the metal composite deck 25 which spans between the bearing points. A fiber reinforced concrete slab 26 may be poured after multiple stories of a structure have been erected. The gypsum board wall fire proofing and acoustic treatment and decorative ceiling finish 27 may then be applied. Furring channels 28 from ½ inch to 1½ inch are attached to the decking to allowing wiring, conduit and piping rods to be installed. Finally, batt installation 29 may be disposed within the wall for its acoustic and thermal properties. This particular embodiment is somewhat faster and less expensive to build and requires fewer parts than the first described embodiment. It also provides a diaphragm slab effect and has improved acoustics.

Figure 3:
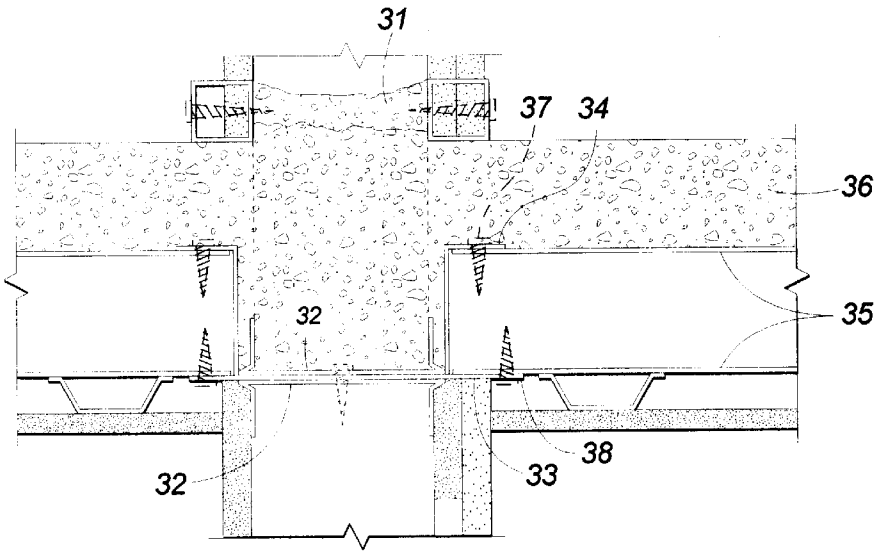
FIG. 3 is a sectional view of a floor wall intersection showing a thicker plate construction and separation between the metal angle closure and metal stud.

FIG. 3 illustrates a slightly modified version of the wall shown in FIG. 2 in which a thicker plate is installed over the top of the walls to allow greater tolerance in deck length. This also allows concrete to seal around the outside of the track 32. Referring to FIG. 3, the walls are designated by numeral 31. As with the other embodiments, top and bottom steel stud tracks 32 are disposed over or under, respectively, the metal stud bearing walls 31 with the track at the top of the wall having a minimum of 16 gauge thickness and being 2 inches deep to support a plate between the studs. The plate 33 is a 12 gauge to ¼ inch steel bearing plate with a 2 inch plus projection from each face of the stud track. The thickness depends on the load on the decking and the distance from the face of the stud to the point of bearing. This plate may be welded or screwed to the top wall track. The bottom wall track may be welded or screwed to the plate. A metal angle 34 with one leg equal to the depth of the decking and the projecting leg of 1¼ inch or more is used to marry the metal composite span deck 35 to the stud wall assembles. The angle 34 should be the same gauge as the deck and the deck is usually applied to the plate first. The angle is then applied over the deck and fastened to each flute with mastic screws 37 disposed through the outer end 38 of the plate 33, or by welding. Finally, a fiber reinforced concrete slab 36 is poured and is continuous through the walls. The concrete is also disposed outside of the bottom track 32 to provide an additional acoustic seal.

In order to achieve longer spans with metal decking of the same depth, two or three span conditions can be used. The decking across the top of the wall does not allow multiple stories of the building to be constructed before pouring the floors. There is also a problem with acoustic flanking paths when voids are created over the wall between rooms or units. By allowing a concrete beam to run through the wall where the composite deck has beams, there is a continuous span that allows 4 to 8 foot greater spans with the same slab depth. Negative reenforcing placed through the wall at the deck beams in the top of the slab could create two or three span conditions.

Figure 4B:
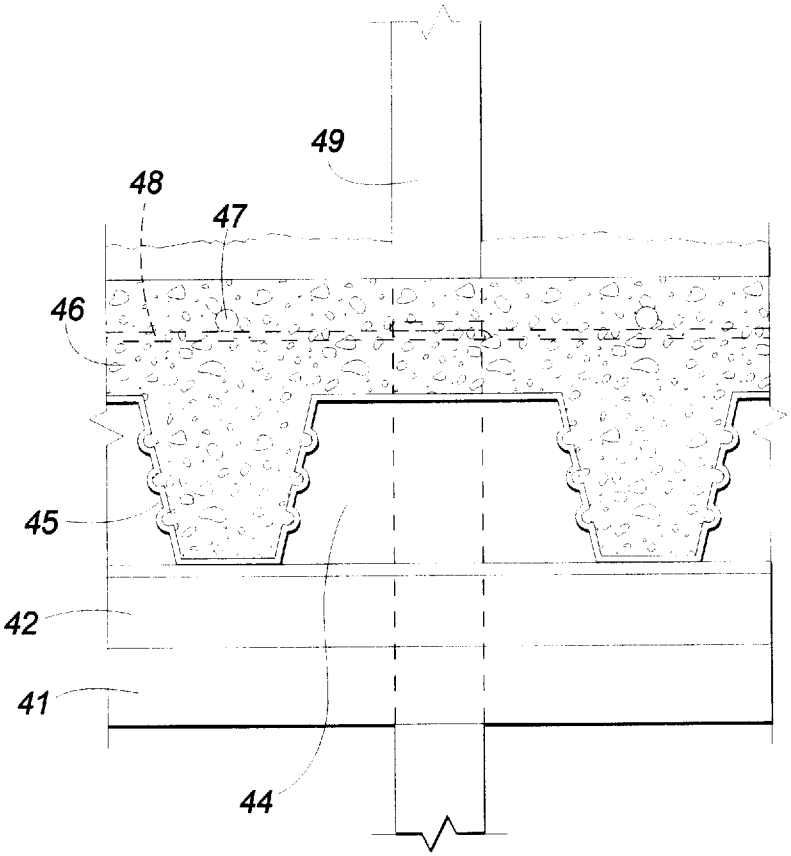
FIG. 4*a* and 4*b* are a sectional view and a partial side elevational view, respectively of a floor wall intersection showing a method of three spanning the floor with steel stud construction.
Figure 4A:
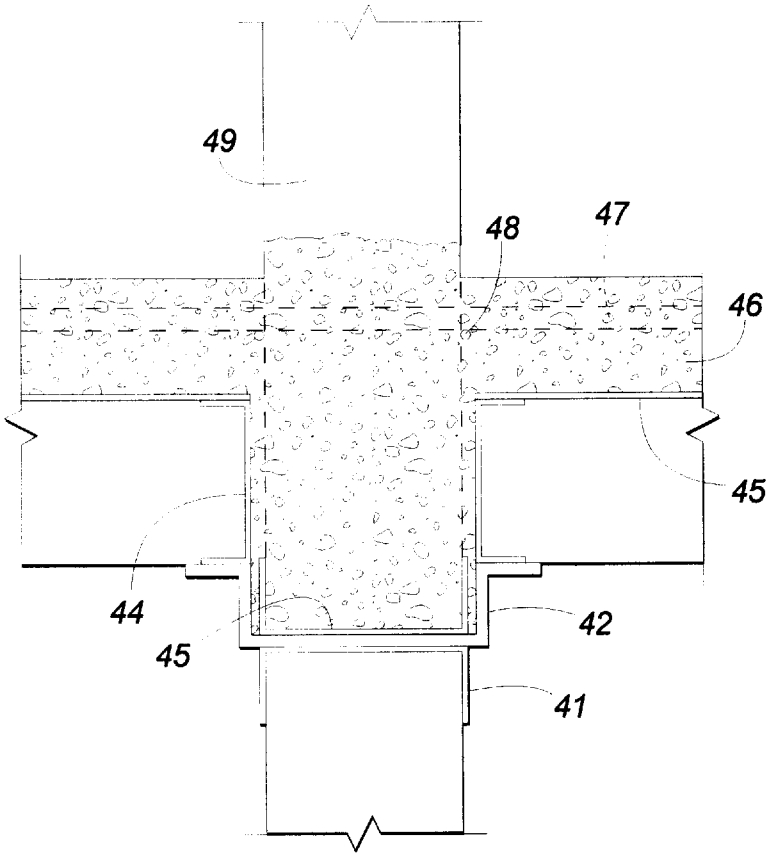

FIGS. 4*a* and 4*b* illustrate an assembly that fits the above-description. FIG. 4*a* illustrates a section through the wall, while FIG. 4*b* illustrates a partial elevation parallel to the wall. The metal studs 49 have a top track member 41 and a bottom track member 43 disposed thereover and thereon, respectively. A bent plate 42 is disposed over the top track 41 to provide support for the decking 35. A formed metal piece 44 to fit the deck flute is installed with mastic from below. Fiber reinforced concrete 46 is disposed over the metal deck 45 and within the cavities of the metal stud 49. Reenforcing bar 47, sized as negative reenforcement for the beams over the top on the wall is installed for two or three span conditions. The reenforcing bar or re-bar is further supported by a wire 48, which is screwed between the studs to support the re-bar in the correct position.

There are some advantages to using wood stud framing for low-rise buildings. This invention allows wood studs to be used with metal decks and concrete topping instead of wood joists which are becoming scarce and expensive. It reduces shrinkage to virtually zero compared with wood joists and wood plates which can shrink ½ inch per floor or more as they dry out. Metal top and bottom tracks instead of wood plates and concrete and steel decks instead of wood joists plywood, and gypcrete provide a shrinkage free floor system with more favorable acoustic properties, no flanking paths and a good seal for pipes that must necessarily pierce the floor construction.

Figure 5:
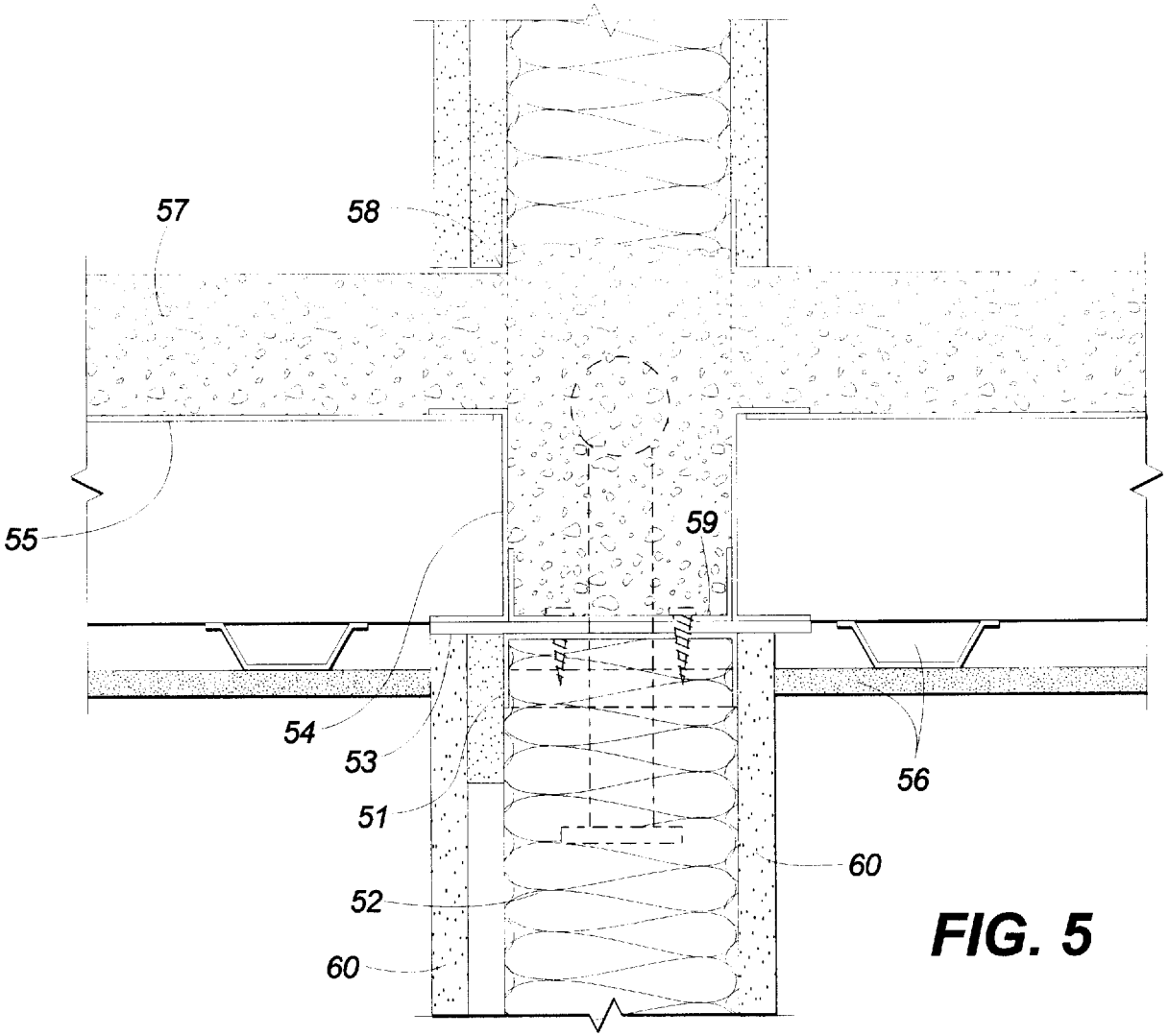
FIG. 5 is a floor wall intersection showing wood frame wall construction with metal deck and concrete floor.

As shown in FIG. 5, a variation of the present invention utilizes deep leg metal tracks 51 that are pre-punched for nailing with wood studs. The entire bearing wall utilizing wood studs is designated by number 52. Disposed over the top of the bearing wall is a bearing plate 53, which is continuous thereover for carrying the metal deck. Secured to the bearing plate is a metal angle closure piece 54 that is the same depth as the metal deck with its top leg over the top of the deck 55. Fiber reinforced concrete, usually lightweight concrete, is disposed over the deck 55. Furring strips and a ceiling finish, both designated as number 56, are applied to the bottom of the deck 55, as desired. A backing for the wall finish is provided by an up-set 58 formed in the fiber reinforced concrete at its junction with a bearing wall on the floor above. As with the previous embodiments, a lower track 59 is used to receive the concrete that is disposed between adjacent floors. A wall finish 60 is then applied directly to the wood studs as required.

Figure 6:
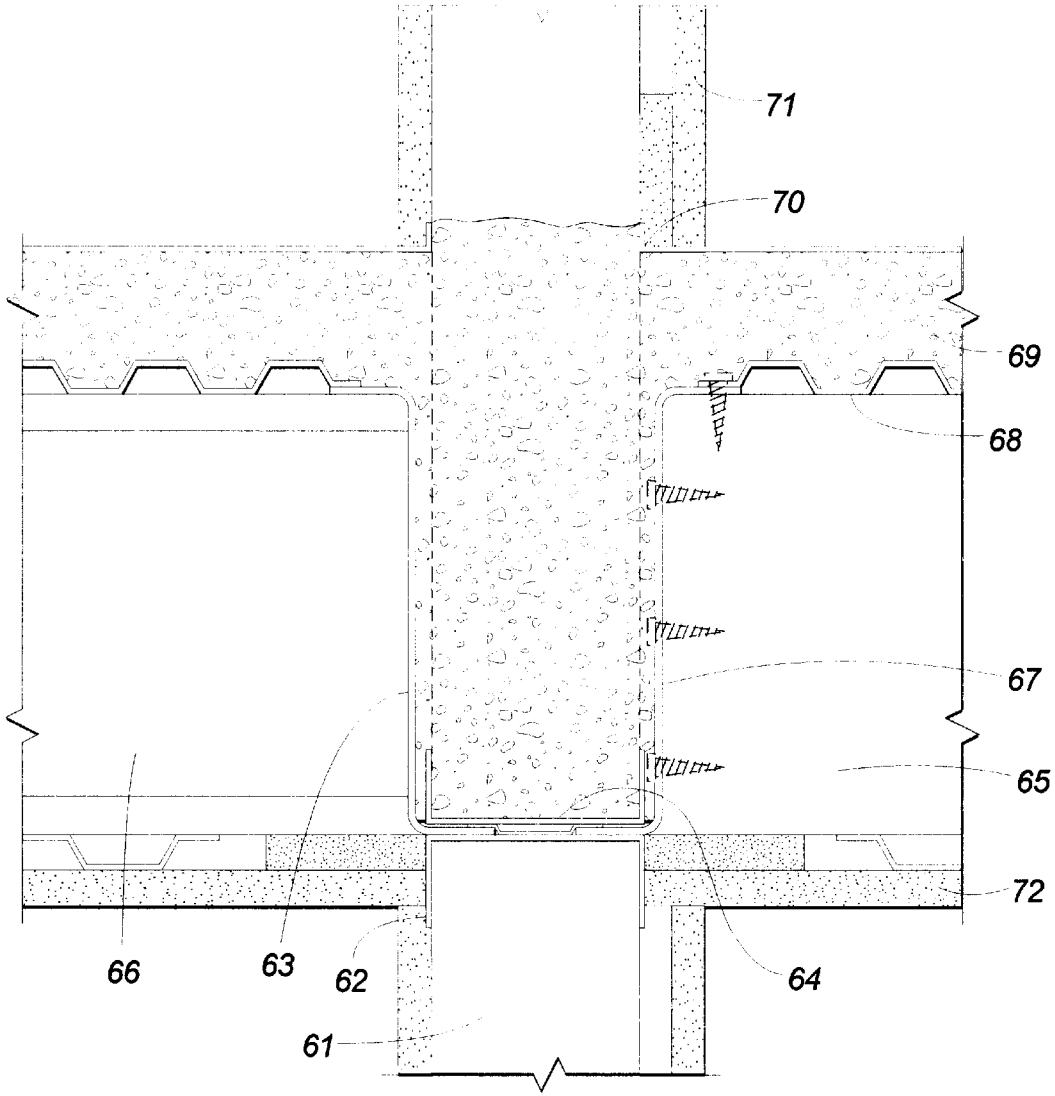
FIG. 6 is a section at a floor wall intersection showing pre-fabricated wood or metal joist floor panels with wood or metal stud walls.

Another modification shown in FIG. 6 and is used when span requirements or other considerations require joisted construction. The axial wall loads are usually transferred through the joist which are bearing upon the stud. In wood framing, this is called "platform" framing which has been adapted to metal framing. The details to accomplish this require reenforcing of the joist ends by labor intensive means which raise the construction costs. The available state of the art joist end reenforcing methods are limited to six to eight stories and they block the floor to floor pipe and mechanical run spaces. The modification illustrated in FIG. 6 allows unlimited stories for steel construction, facilitates the sealing of pipe penetrations and eliminates acoustic bridges that currently adversely affect joisted constructions. It will be seen from the drawing that the main difference between this embodiment and the previous embodiments is the use of a deep track 62 disposed over the stud wall 61 and a structural "Z" shaped member 63 which is sized for the end of the joist 66. For illustration purposes, a wood joist 65 is also shown. Screws 67 or other suitable fasteners in shear fastening arrangement are used to help secure the structural "Z" member to the joist, whether it be metal or wood. Decking is applied over the joist, and is either metal, or plywood for a wood joist system. As with the other embodiments, fiber reinforced concrete is normally applied over the decking material and an up-set concrete lip 70 is provided for securing drywall finishes 71 thereto, as required by the particular building. Over the drywall or other finish, a ceiling member 72 is provided for acoustic and aesthetic properties.

Figure 7:
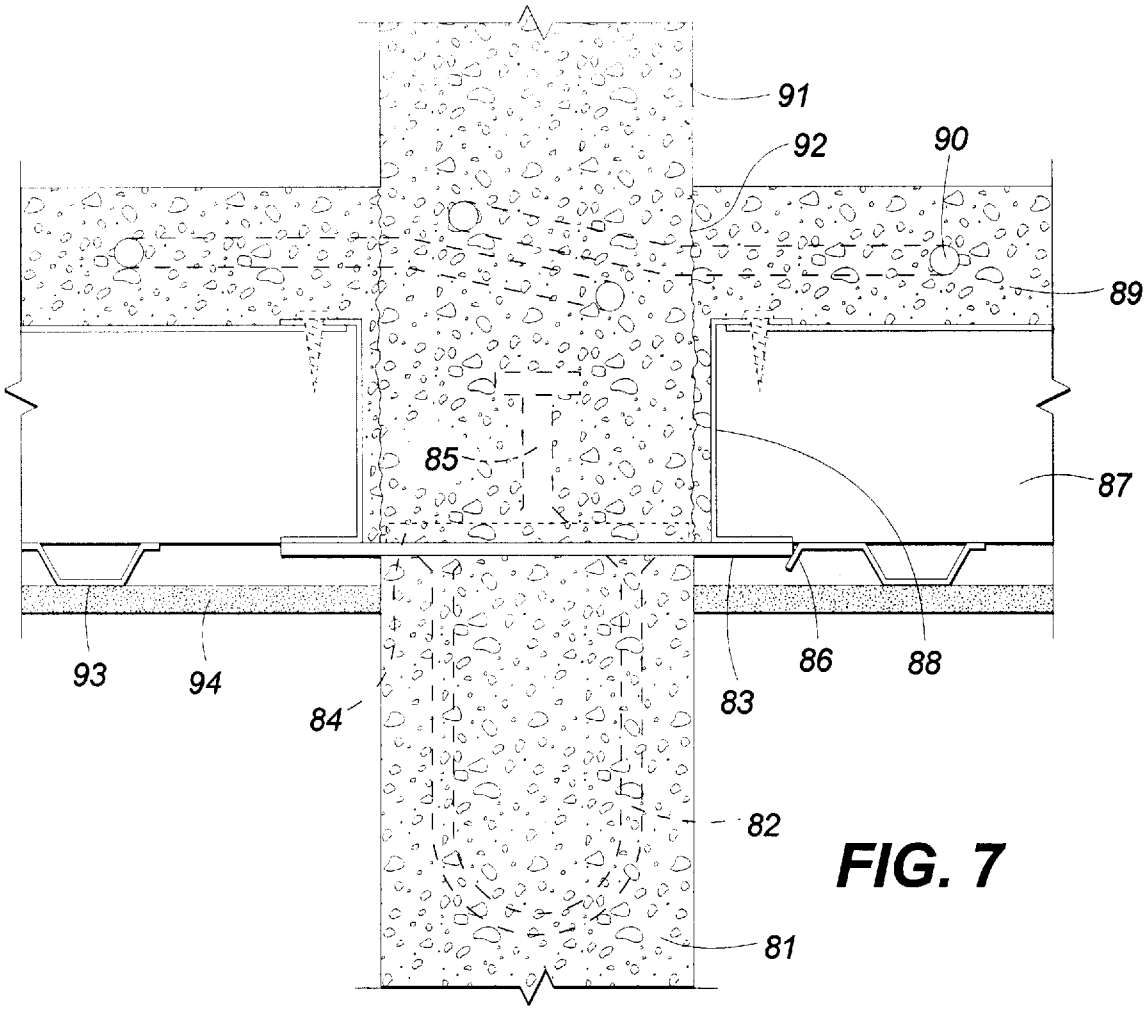
FIG. 7 is a section at a floor wall intersection showing a pre-cast wall and a metal deck and concrete topping floor.

Concrete floor and wall structures normally place the floor on the top of walls, one floor at a time, and hold the structure together with welded plates or packed joints using steel re-bar and expensive cement. The plate can not be left exposed and there is a finish cover required in various areas due to this. The method requires a considerable amount of hand placed grout with its associated irregularities and is labor intensive, slow, and heavy. A modification of the invention shown in FIG. 7 allows pre-cast concrete finish surface walls with bond bars from a wall into subsequently placed concrete topping for a bottom connection at each floor line. The top of the concrete wall has a steel plate bonded into the wall. The plate allows welded connection from the composite metal decking that is placed on top of the plate projections. The bottom of the wall above has plates cast in periodically that are welded to the plates on top of the wall below to allow the structure to be erected without topping concrete. The top of the wall plate is also used for erection pick-up and for tying segments of the wall together. Vertical joints in the pre-cast wall can usually be positioned to fall under intersecting walls.

In this embodiment, which is slightly modified from the previous modifications, a concrete pre-cast bearing wall 81 is provided with a bent bar 82 embedded in the wall and welded to a plate member 83. The plate is continuous on the top of the wall with projections on each side as required to carry the span. A steel plate 84, the width of the wall, is cast into the bottom of the wall and welded to the top of the wall plate during erection at 86. A welded stud is attached thereto at each embedded bottom plate. Composite metal decking 87 is provided over the plate member 83. A metal angle closure 88 is provided on the sides of the concrete bearing wall, the angle being continuous and the same gauge as the deck. This seals off the end of the deck and inhibits step-down. A concrete topping 89 is applied over the composite decking to a required or desired depth. In this embodiment, re-bar loops 90 are cast half into the pre-cast wall and half into the concrete topping or bolt inserts and bolts are used. A smooth surface 91 is applied over the concrete wall area with a rough surface concrete wall 92 disposed below the floor finish line. Metal channels 93 may be attached to the metal deck if required for plumbing and wiring requirements and a gypsum board 94 can be applied thereto if desired or required by the particular building.

Figure 8:
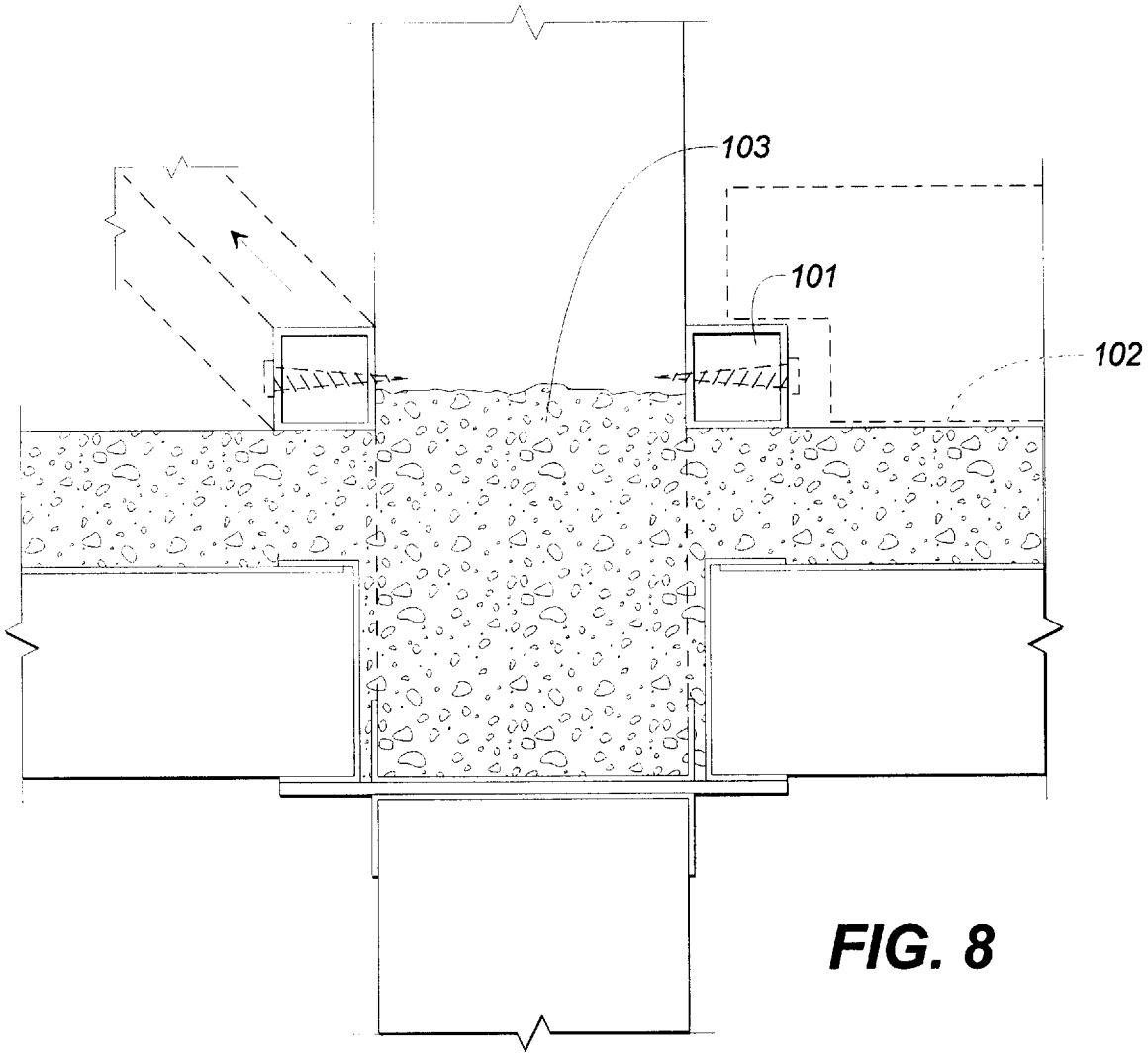
FIG. 8 is a section at a floor wall intersection showing removable screed and a notched leveling screed tool.

With all of the previously described embodiments, and using FIG. 3 as an illustrative example, FIG. 8 shows a removable screed guide that can be applied to stud faces in a manner that a notched screed concrete leveling device can create a uniform slab between two screeds at opposite sides of a room. The space between the screed guides at both sides of a stud wall can be filled with concrete above the finished floor height. This raised concrete area provides a backing for drywall finishes that creates a good acoustic seal and helps prevent impact damage to the base of the drywall. In the example shown in FIG. 8, numeral 101 designates a metal tube screed which is pre-punched for screws at 4 inches on center for attachment to studs. The tube is oiled for ease of removal. A notched concrete leveling screed 102 rides on the tube screed at each end to produce a level slab without having to remove a temporary screed within the pour and then filling the void by hand. The concrete 103 is then poured between the screeds within the metal stud wall. Upon removal of the temporary screeds, a vertical concrete surface, flush with the stud face, is left as a backup for drywall. Once the wall has been erected, diagonal tension straps can be used to stabilize the wall.

Figure 9:
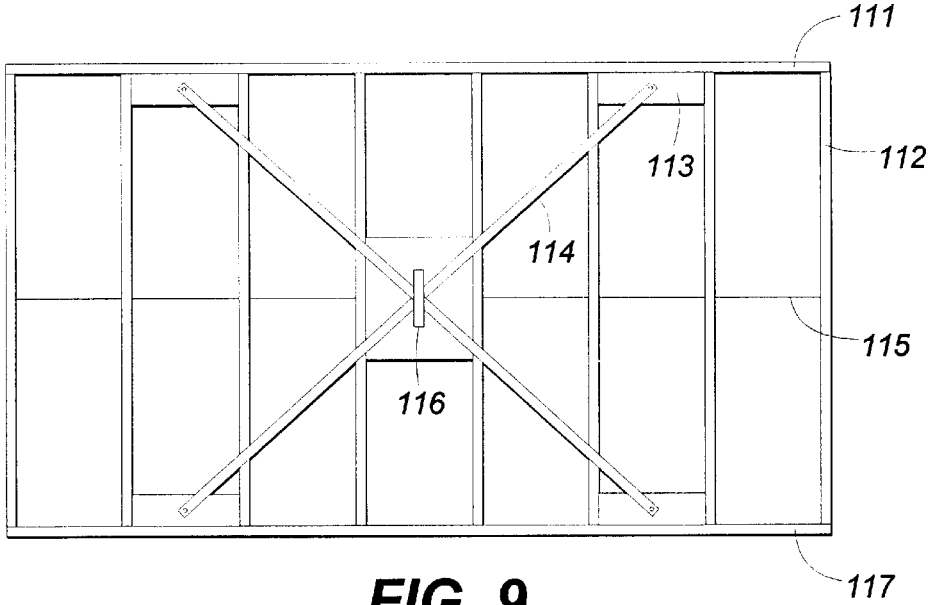
FIG. 9 is a panel elevation showing a metal stud panel with diagonal tension strapping.

FIG. 9 illustrates a typical wall panel with diagonal tension straps. The metal studs 112 comprising the wall panel are secured with a top track 111 and a bottom track 117. A plate 113 or a track piece is welded to both the studs and the top and bottom tracks. The diagonal tension straps 114 are welded to the top and bottom track pieces or plates. Rather than using conventional bracing between the studs, illustrated simply for convenience as number 115, a tensioning device 116 is used to strengthen the wall panels. The details of the tensioning device are disclosed and discussed hereinbelow. The diagonal tension straps must be tight and are normally pre-tensioned in order to perform properly and not damage the building or the finishes or make noises during horizontal loading events, such as wind or seismic events. The methods used heretofore are expensive and labor intensive and require great care to equalize the tension in all the straps. The method shown in this invention requires only a fraction of the material and labor costs of previous methods and it is convenient and simple to install and to operate. Work can be done at a convenient height by a single worker.

Figure 10:
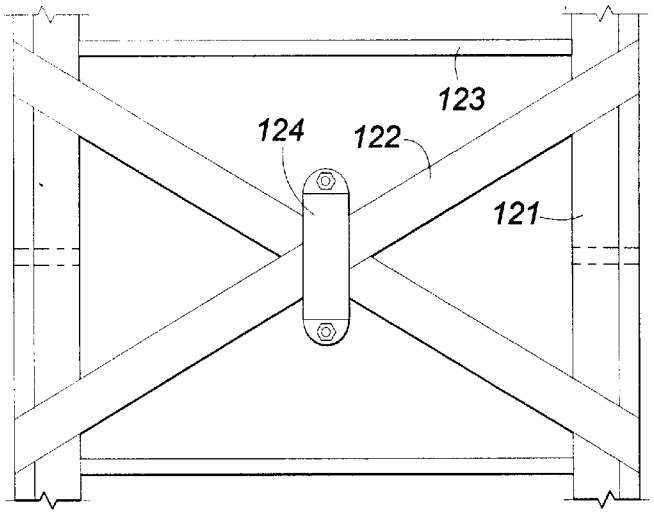
FIG. 10 is an enlarged elevation of the tensioning device at the strapping overlap point, a plan view of the same condition and a section through the tensioning device.
Figure 12:
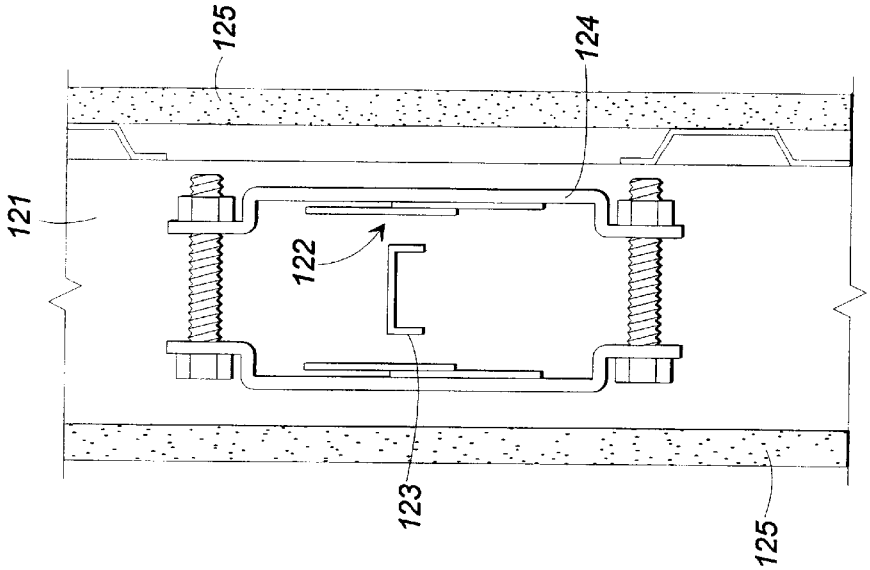
FIG. 12 is a section through the tensioning device.
Figure 11:
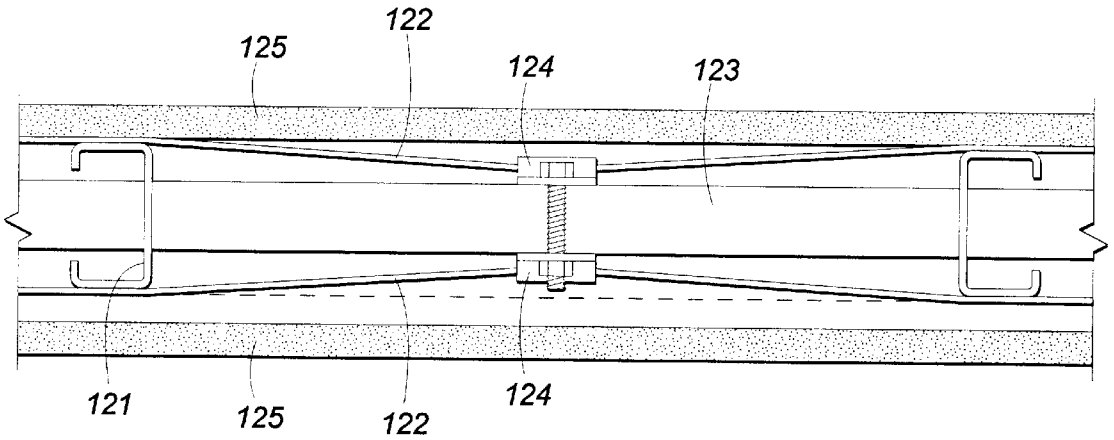
FIG. 11 is a plan view of the tensioning device at the overlap point.

FIGS. 10, 11 and 12 illustrate in detail the tensioning system used on the diagonal straps. The stud 121 has a web that faces the tensioning device. This stud is disposed on both sides thereof as shown in FIGS. 10 and 11. The diagonal straps 122 are hand tensioned during fabrication to prevent racking of the panel. After erection, but before the drywall or other finish is placed, the straps can be tensioned by the tensioning device, pulling the straps into the stud void as shown in FIG. 11. Both the device and the bolts can be clear of the drywall finish. The bolt may be cut after tensioning if required. The straps may be fully welded to the top and bottom plates when hand tensioned, as described hereinabove. Stud bridging is illustrated by numeral 123. A 1½ inch channel is shown welded to the stud webs to prevent rotation or bending of the studs. The bridging may be continuous at the stud center line if the straps are tight before tensioning. The diagonal strap tensioning device 124 includes two bolts. One-half of the device is placed on each side of the diagonal straps at the crossing point and bolts are inserted between them. The bolt and nut are kept within the void space by offsetting the device plates. The nuts are tightened, i.e. as with a torque wrench, until the straps are at the desired tension. All four straps are simultaneously and equally tightened. Once the tensioning is complete, drywall 125 or other suitable finish is installed on the stud faces as the tensioning device and the bolts are now disposed in the interior of the stud wall. The bolts may be cut after tightening if the projection interferes with the finishes.

Thus, while an embodiment and modifications thereof of a bearing wall construction system wherein axial loads of the walls do not pass through the floor construction have been shown and described in detail herein, various additional changes and modifications may be made without departing from the scope of the present invention.

I claim:

1. A multiple story building, comprising:

a plurality of walls, each said wall comprising a plurality of metal wall members, said walls being substantially continuous from foundation to roof;

said metal wall members having track means secured thereto;

a plurality of bearing members having bearing surfaces projecting therefrom interposed between said track means;

means for connecting said bearing members to said track means; and a multi-layer floor extending between said walls, said floor comprising a first layer having first and second surfaces, said first surface resting on said bearing surfaces such that said wall axial loads do not pass through said floor construction and a second layer disposed on said first layer, wherein said second layer is in contact with said first layer over substantially the entirety of said second surface.

2. The multiple story building of claim 1, wherein said first layer is a metal deck.

3. The multiple story building of claim 1, wherein said second layer comprises concrete.

4. The multiple story building of claim 1, wherein said bearing members include a wall cap.

5. The multiple story building of claim 1, wherein said bearing members include a metal plate.

6. The multiple story building of claim 1, wherein said wall members comprise light gauge steel.

* * * * *